US007772482B2

(12) United States Patent
Shibata

(10) Patent No.: US 7,772,482 B2
(45) Date of Patent: Aug. 10, 2010

(54) ELECTRONIC MUSICAL INSTRUMENT AND COMPUTER-READABLE RECORDING MEDIUM

(75) Inventor: Koichiro Shibata, Aisai (JP)

(73) Assignee: Yamaha Corporation (JP)

( * ) Notice: Subject to any disclaimer, the term of this patent is extended or adjusted under 35 U.S.C. 154(b) by 222 days.

(21) Appl. No.: 11/612,891

(22) Filed: Dec. 19, 2006

(65) Prior Publication Data

US 2007/0137468 A1 Jun. 21, 2007

(30) Foreign Application Priority Data

Dec. 21, 2005 (JP) ..... 2005-367996

(51) Int. Cl.

| | |
|---|---|
| ***G10H 3/00*** | (2006.01) |
| ***G10H 3/14*** | (2006.01) |
| ***G10H 1/06*** | (2006.01) |
| ***G10H 1/32*** | (2006.01) |
| ***G10H 1/34*** | (2006.01) |

(52) U.S. Cl. ..... 84/734; 84/723; 84/735; 84/743

(58) Field of Classification Search ..... 84/723, 84/734, 735, 743

See application file for complete search history.

(56) References Cited

U.S. PATENT DOCUMENTS

| | | | | |
|---|---|---|---|---|
| 2,138,500 | A | 11/1938 | Miessner | |
| 3,767,833 | A | 10/1973 | Noble et al. | |
| 4,314,228 | A * | 2/1982 | Eventoff | 338/114 |
| 5,069,106 | A | 12/1991 | Sakashita | |
| 5,245,130 | A | 9/1993 | Wheaton | |
| 5,543,580 | A | 8/1996 | Masuda | |
| 5,922,985 | A | 7/1999 | Taniwaki | |

FOREIGN PATENT DOCUMENTS

| | | | |
|---|---|---|---|
| GB | 2 221 078 | A | 1/1990 |
| JP | 6-97396 | B2 | 11/1994 |
| JP | 07-072853 | A | 3/1995 |
| JP | 7-199919 | A | 8/1995 |
| JP | 08-305362 | A | 11/1996 |
| JP | 10-055178 | A | 2/1998 |
| JP | 10-149737 | A | 6/1998 |

(Continued)

OTHER PUBLICATIONS

Yamaha, "WX5 Wind MIDI Controller Owner's Manual", Mar. 3, 1998, pp. 10, 11, 26, 28 and 40, retrieved from http://www.yamaha.com/yamahavgn/Documents/KeyboardDMI/wx5.pdf>, on Feb. 8, 2007, Yamaha, Japan.

(Continued)

*Primary Examiner*—Jeffrey Donels
*Assistant Examiner*—Andrew R Millikin
(74) *Attorney, Agent, or Firm*—Rossi, Kimms & McDowell LLP

(57) ABSTRACT

An electronic musical instrument includes a performance operation portion that is operated by fingers of a performer, a contact portion that is adapted to be brought into contact with a lower lip of the performer, a contact pressure detection portion that detects the contact pressure at which the lower lip is brought into contact with the contact portion, and generates a pressure value in accordance with the detected contact pressure, and a control portion that specifies sound of a pitch in accordance with an operation status of the performance operation portion and changes the pitch of the sound in accordance with the pressure value.

12 Claims, 8 Drawing Sheets

FOREIGN PATENT DOCUMENTS

| | | | |
|---|---|---|---|
| JP | 11-052956 | A | 2/1999 |
| JP | 2003-141962 | A | 5/2003 |

OTHER PUBLICATIONS

The extended European Search Report for corresponding European Patent Application No. 06026438.9-2225, dated Feb. 22, 2007.

Notification of Reason for Refusal issued in corresponding Japanese Patent Application No. 2005-367996 dated Oct. 27, 2009. English translation only provided.

* cited by examiner

FIG. 6

| FINGERING | FIRST OCTAVE | SECOND OCTAVE |
|---|---|---|
| ... | ... | ... |
| ... | ... | ... |
| ... | ... | ... |
| ... | ... | ... |
| ... | ... | ... |

ELECTRONIC MUSICAL INSTRUMENT AND COMPUTER-READABLE RECORDING MEDIUM

BACKGROUND OF THE INVENTION

The present invention relates to an electronic wind instrument for electronically reproducing the blown sound of a natural wind instrument.

As is well known, an electronic wind instrument has operation elements imitating their counterparts of a natural wind instrument, such as breath inlet holes and operation keys. When breath is blown into the instrument via the breath inlet hole, a pitch is determined in accordance with fingering that is a combination of depression of the performance key and the blowing of a breath. Blown sound whose level corresponds to the pressure of the breath blown in through a breath inlet hole is synthesized and produced at the thus-determined pitch.

Attempts have hitherto been made to detect the style of rendition unique to the natural wind instrument called a "resonance mode change" and to realize an electronic music wind instrument capable of electronically reproducing the sound blown pursuant to the style of rendition.

The "resonance mode change" means the style of rendition for a musical instrument which does not have performance keys used for switching an octave, as in the case of a flute. Under this style of rendition, movements of the lower lip called "embouchure" for blowing breath are subtly changed, to thus control an octave, or the like, of blown sound with fingering being fixed. Sometimes, the resonance mode change is also called an "overblow," an "octave switching," a "lip slur," and the like.

JP-A-7-199919 discloses an electronic wind instrument capable of intricately detecting the resonance mode change. The electronic wind instrument described in JP-A-7-199919 detects the direction of inflow of blown breath by a plurality of breath pressure detection sensors discretely arranged in the breath inlet holes. After the current resonance mode has been specified by a detected direction, a sound source is instructed to produce an output of a musical sound signal of a pitch complying with the resonance mode.

However, as mentioned previously, the performer of a natural wind instrument performs a resonance mode change by subtly altering the manner of moving the lower lip rather than intentionally changing the direction of blowing of breath. Therefore, in the case of JP-A-7-199919 which relates to mere application of the blowing direction of breath to detection of a resonance mode, a discrepancy arises between the performer's intention and actually-output sound, to thus result in a failure to achieve superior performance operability.

SUMMARY OF THE INVENTION

The present invention has been conceived against such a background and aims at providing an electronic wind instrument capable of reproducing, in a realistic manner, performance operability such as that achieved during the resonance mode change of a natural wind instrument.

It is therefore an object of the present invention to provide an electronic musical instrument, comprising: a performance operation portion that is operated by fingers of a performer; a contact portion that is adapted to be brought into contact with a lower lip of the performer; a contact pressure detection portion that detects the contact pressure at which the lower lip is brought into contact with the contact portion, and generates a pressure value in accordance with the detected contact pressure; and a control portion that specifies sound of a pitch in accordance with an operation status of the performance operation portion and changes the pitch of the sound in accordance with the pressure value.

Preferably, the contact pressure detection portion is a membrane switch. The membrane switch includes an upper electrode sheet having an electrode on a front surface thereof, a lower electrode sheet having an electrode on a front surface thereof, and a pressure-sensitive conductor sandwiched between the front surfaces of the upper and lower electrode sheets.

A back surface of the lower electrode sheet is bonded to a lip member. One end of the contact portion is pivotally jointed to the lip member so that the upper electrode sheet can be depressed toward the lower electrode sheet in accordance with a movement of the contact portion.

Preferably, a protruding section is provided on the contact portion.

Preferably, the control portion determines whether or not the pressure value exceeds a predetermined threshold value. The control portion changes the pitch of the current sound to a pitch which is one octave higher than the pitch of the current sound when it is determined that the pressure value exceeds the threshold value.

According to the present invention, there is also provided a computer-readable recording medium for causing an electronic musical instrument including a performance operation portion that is operated by fingers of a performer, a contact portion that is adapted to be brought into contact with a lower lip of the performer, a contact pressure detection portion that detects the contact pressure at which the lower lip is brought into contact with the contact portion and generates a pressure value in accordance with the detected contact pressure, to execute a pitch changing method, the method comprising:

specifying sound of a pitch in accordance with an operation status of the performance operation portion; and changing the pitch of the sound in accordance with the pressure value.

The present invention enables provision of an electronic musical instrument capable of realizing, in a realistic manner, performance operability such as that achieved when the resonance mode of a natural musical instrument is altered.

BRIEF DESCRIPTION OF THE DRAWINGS

The above objects and advantages of the present invention will become more apparent by describing in detail preferred exemplary embodiments thereof with reference to the accompanying drawings, wherein:

FIG. 6 is a view showing the data structure of a fingering table;

DETAILED DESCRIPTION OF THE PREFERRED EMBODIMENTS

First Embodiment

A first embodiment of the present invention will be described.

The feature of the present invention lies in that the sound source is caused to output musical sound of a pitch corresponding to standard embouchure in response to fingering detected by performance keys during the period of a pressure—at which the lower lip is brought into contact with a breath inlet hole of a flute-like electronic musical instrument (hereinafter called an "electronic flute")—remaining lower than a predetermined threshold value; and that, when the contact pressure has exceeded the threshold value, the sound source outputs musical sound of a pitch corresponding to an octave-raised embouchure.

Figure 1:
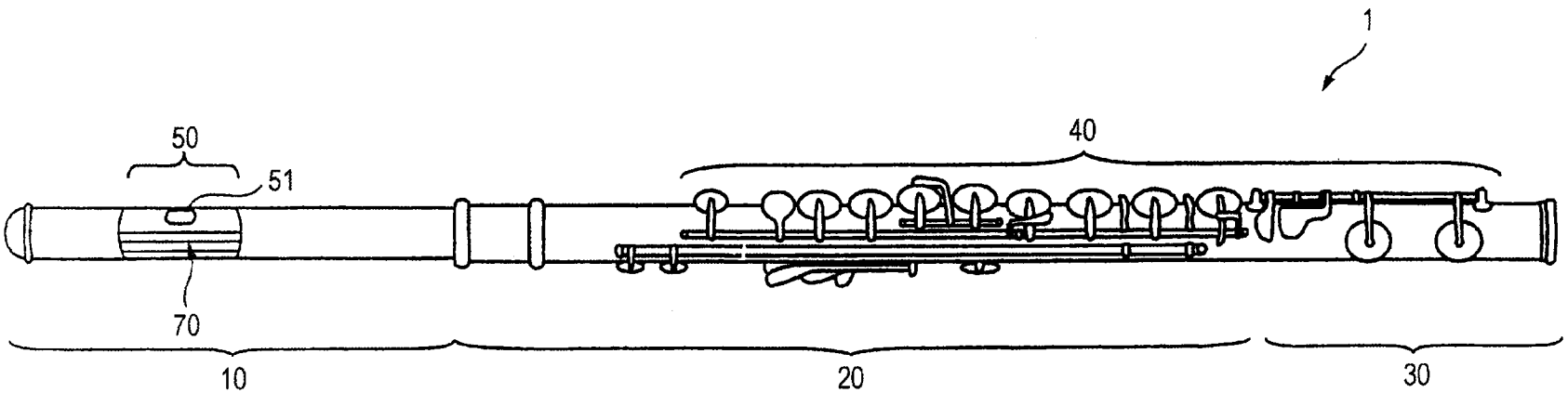
FIG. 1 is a view showing the external view of an electronic flute.

FIG. 1 is a view showing the external view of the electronic flute 1 of the present embodiment. As illustrated, an enclosure of this electronic flute 1 includes an upper pipe section 10, a main pipe section 20, and a lower pipe section 30. Performance keys 40 serving as operation elements for receiving operation of fingers of the performer are provided on the main pipe section 20 and the lower pipe section 30. A lip plate 50 serving as an operation element for receiving operation of a lip is provided on the upper pipe section 10. Moreover, the lip plate 50 is provided with a breath inlet hole 51 and an embouchure detection section 70.

Figure 2:
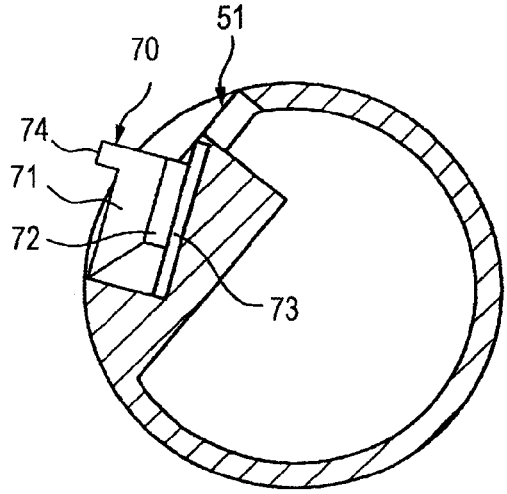
FIG. 2 is a view showing an embouchure detection section.

FIG. 2 is a cross-sectional view of the lip plate showing the configuration of the embouchure detection section 70. As illustrated, an indentation having an essentially-L-shaped cross sectional profile is formed in the base section in the area forward of the breath inlet hole 51 of the lip plate 50. An embouchure detection section 70 including a swinging portion 71, a formed rubber 72, and a membrane switch 73 is housed in the indentation.

Figure 3:
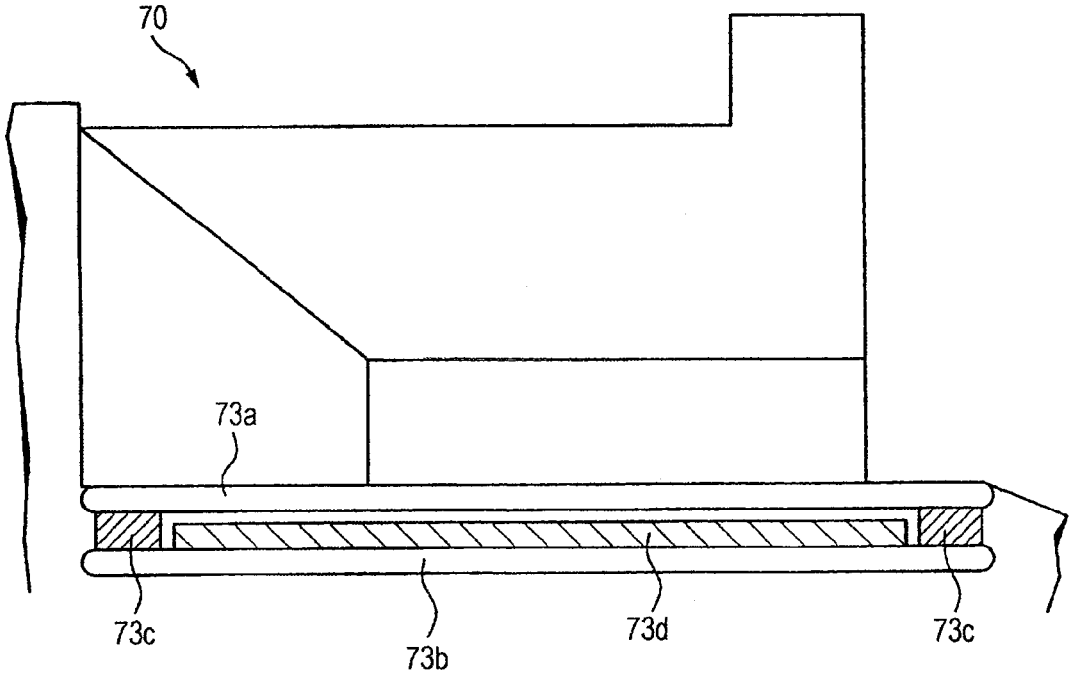
FIG. 3 is a view showing a membrane switch.

As shown in FIG. 3, the membrane switch 73 is configured that an upper electrode sheet 73*a* having an electrode on a front surface thereof and a lower electrode sheet 73*b* having an electrode on a front surface thereof are arranged in such a way that a membrane space 73*c* and pressure-sensitive conductive rubber 73*d* are sandwiched between the front surfaces of the upper and the lower electrode sheets 73*a* and 73*b*. The back surface of the lower electrode sheet 73*b* is bonded to a longitudinal face of the indentation.

In FIG. 2, the swinging portion 71 is a member having a tapered shape which becomes thinner from an upper face to a lower face. A rear end of the upper face is joined to upper ends of lateral faces of the indentation so as to become swayable in the vertical direction. The front edge of the upper face of the swinging portion 71 is slightly bluff upwardly, to thus form an essentially-straight protruding section 74. The essentially-rectangular-parallelepiped formed rubber 72 is affixed to the lower face of the swinging portion 71. This swinging portion 71 transmits the contact force exerted by the lower lip of the performer to the membrane switch 73 by swaying movement of the actuator. The reason why the protruding section 74 is provided along the front edge of the upper face of the swinging portion 71 is because the contact pressure of the lower lip is transmitted to the membrane switch 73 with higher accuracy.

Figure 4A:
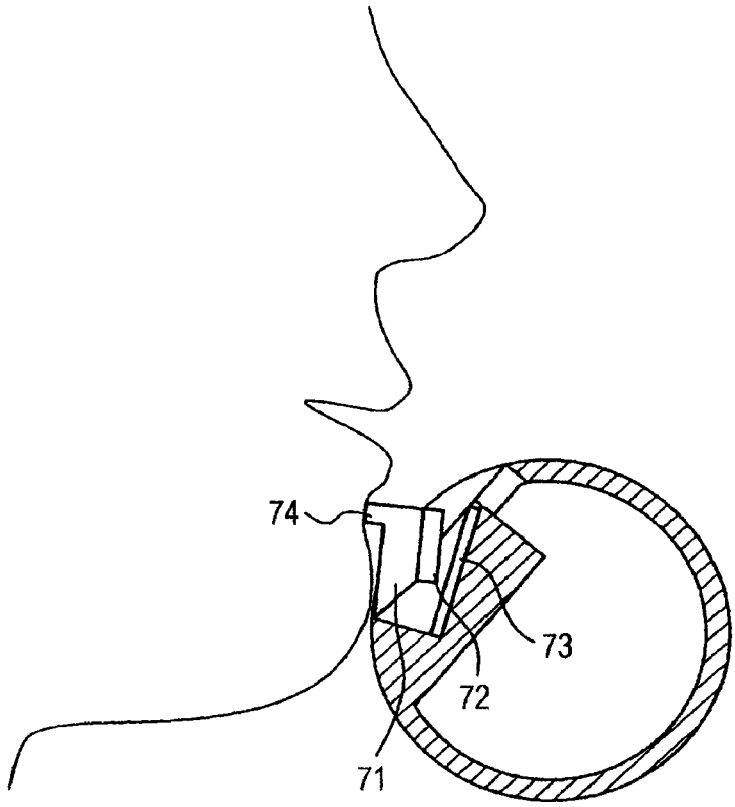
FIGS. 4A and 4B are views showing the principle of transmission of a contact pressure of a lower lip to the membrane switch.
Figure 4B:
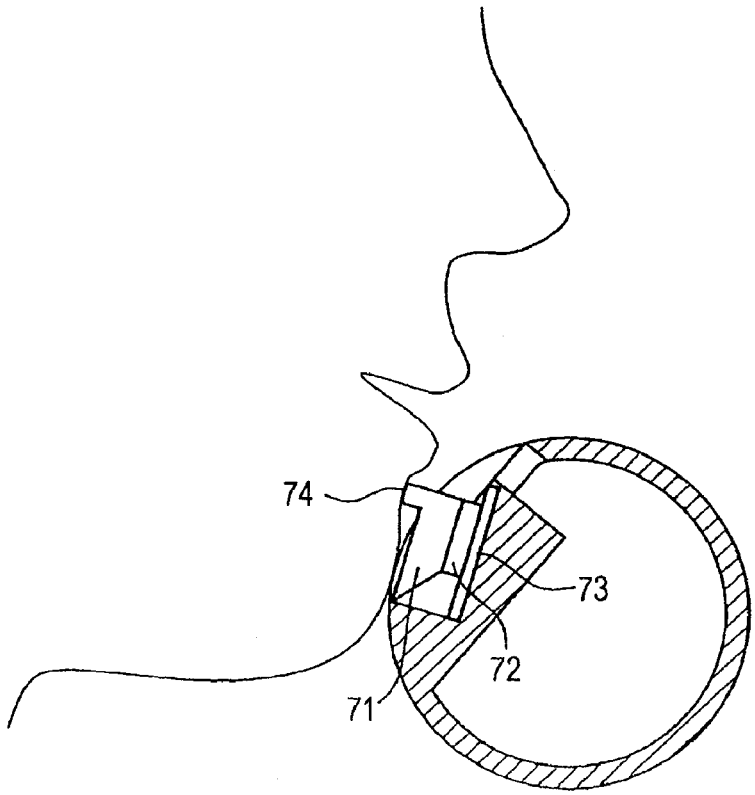

FIGS. 4A and 4B are drawings showing the principle on which the contact pressure of the lower lip of the performer to the swinging portion 71 is transmitted to the membrane switch 73. As is well known, the pressure-sensitive conductive rubber 73*d* has the property of electrical resistance becoming smaller in the direction of compression as the rubber is compressed. Since a connection between the swinging portion 71 and the lip plate 50 is impelled upwardly with small force, the electrical resistance of the pressure-sensitive conductive rubber 73*d* becomes infinite when the swinging portion 71 is not depressed so as to contact to the pressure-sensitive conductive rubber 73*d* by the lower lip of the performer, as shown in FIG. 4A, whereby a voltage appearing in the point of contact between the upper electrode sheet 73*a* and the lower electrode sheet 73*b* becomes maximum. As shown in FIG. 4B, when the lower lip of the performer depresses the protuberance section 74 of the swinging portion 71 upon contacting the same, the electrical resistance of the pressure-sensitive conductive rubber 73*d* becomes gradually lower, whereby the voltage across the point of contact is reduced.

Figure 5:
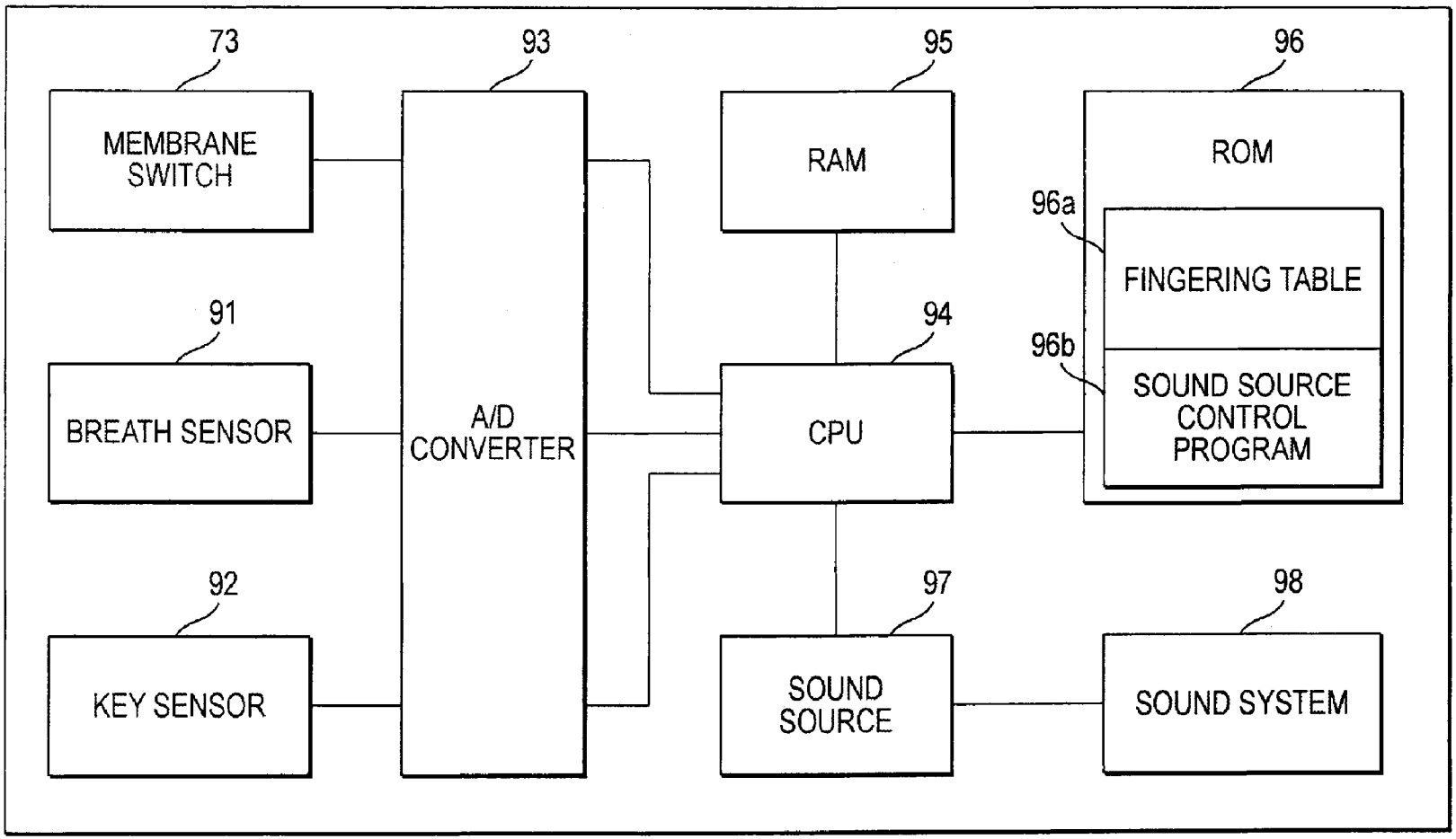
FIG. 5 is a view showing the electrical configuration of the electronic flute.

FIG. 5 is a view showing an electrical configuration of the electronic flute 1. In the drawing, the elements provided on the enclosure have already been described by reference to FIG. 1, and the like, the same reference numerals are assigned to those elements, and repeated descriptions thereof are omitted. In addition to including the membrane switch 73, the electronic flute 1 includes a breath sensor 91, a key sensor 92, an analog/digital (hereinafter called an "A/D") converter 93, a CPU 94, RAM 95, ROM 96, a sound source 97, and a sound system 98.

Features of the illustrated individual sections are generally described. First, the breath sensor 91 detects the pressure value of breath blown in the breath inlet hole 51 formed in the lip plate 50 of the upper pipe section 10, and supplies to the A/D converter 93 a signal showing the thus-detected pressure value.

The key sensor 92 individually detects depression/nondepression of each of the performance keys 40 provided from the main pipe section 20 to the lower pipe section 30, and supplies the A/D converter 93 with a signal showing the depressed state of each of the keys.

The A/D converter 93 subjects a signal supplied by the breath sensor 91 to A/D conversion, and supplies the CPU 94 with the thus-converted signal as breath pressure data. The A/D converter subjects the signal supplied from the key sensor 92 to A/D conversion, and supplies the thus-converted data to the CPU 94 as depressed key data. Moreover, the A/D converter 93 subjects to A/D conversion a voltage value applied between the electrodes of the upper and lower electrode sheets 73*a* and 73*b* of the membrane switch 73, and supplies the resultant value to the CPU 94 as contact pressure data.

The ROM 96 stores a fingering table 96*a* and a sound source control program 96*b*.

FIG. 6 is a view showing the data structure of the fingering table 96*a*. As illustrated, this table has three fields; namely, the field of "fingering," the field of "first octave," and the field of "second octave."

Depression key data showing fingering are stored in the field of "fingering." First octave pitch data are stored in the field of "first octave." The first octave pitch data are data showing the pitch of musical sound output during playing at a standard embouchure. Second octave pitch data are stored in the field of "second octave." The second octave pitch data are data indicating a pitch which is higher than the first octave pitch data by one octave.

The sound source control program 96*b* is a program for imparting the CPU 94 with a characteristic feature of the present embodiment.

The sound source 97 has waveform memory into which sound waveform data at each of the pitches of the flute are gathered. Upon receipt, from the CPU 94, of the sound source control signal used for specifying the pitch of an output sound, the sound source 97 amplifies to a preset sound level a sound signal synthesized on the basis of the sound waveform data that are stored in the waveform memory of the sound source in association with the pitch; and supplies the sound system 98 with the amplified sound signal. The sound system 98 produces a sound corresponding to the sound signal.

Figure 7:
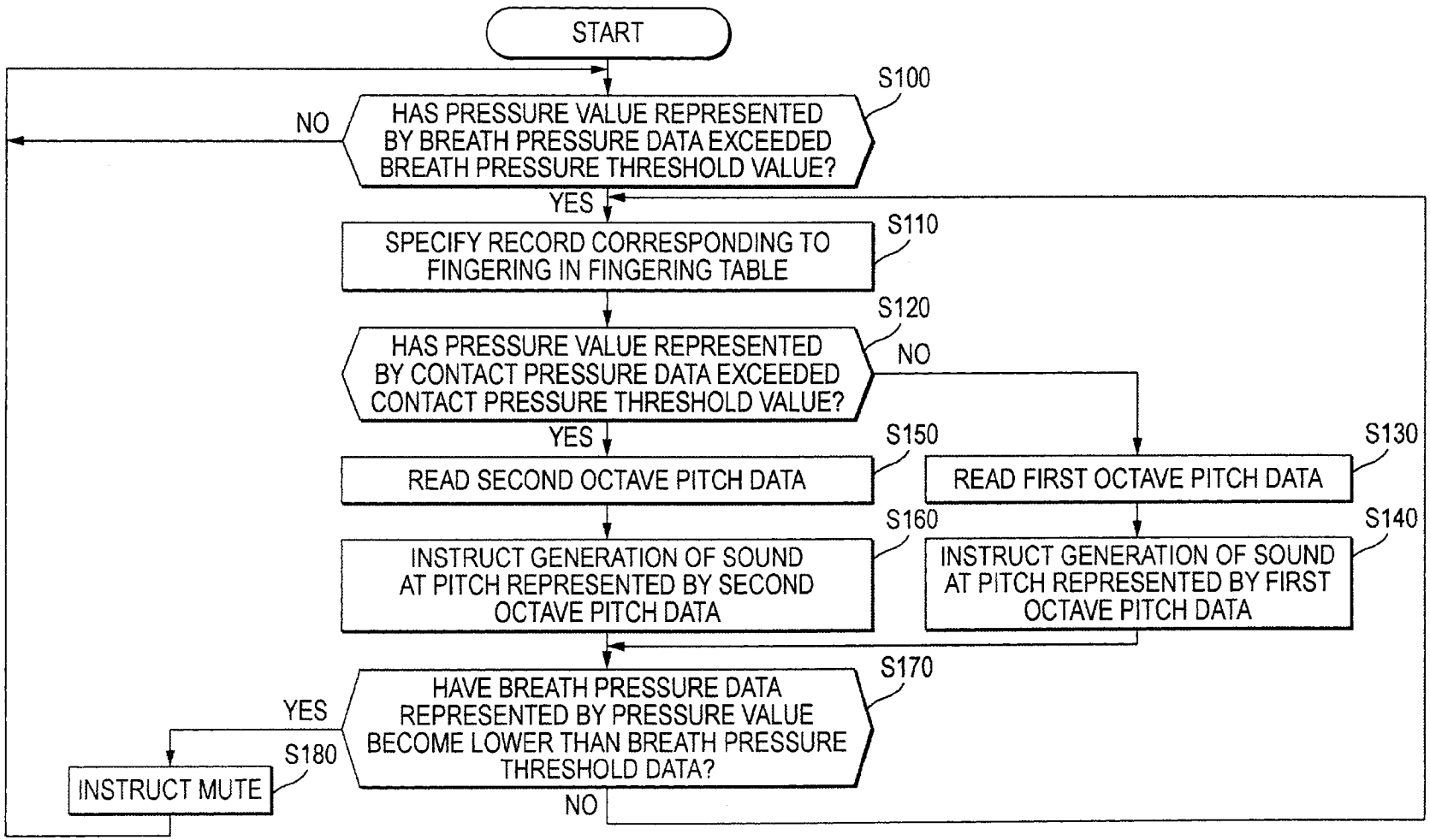
FIG. 7 is a flowchart showing operation of the electronic flute according to a first embodiment.

FIG. 7 is a flowchart showing operation of the present embodiment.

Illustrated processing is performed every time the breath pressure data are supplied to the CPU 94.

Upon receipt of a supply of breath pressure data from the A/D converter 93, the CPU 94 determines whether or not a pressure value indicated by the supplied breath pressure data has exceeded the preset breath pressure threshold value (S100).

When the pressure value represented by the breath pressure data are determined to have exceeded the breath pressure threshold value, the CPU 94 specifies, from the fingering table 96*a*, the record stored in the field of "fingering" through use of the depression key data supplied from the A/D converter 93 (S110).

The CPU 94 having specified the record in the fingering table 96*a* determines whether or not the pressure value represented by the contact pressure data supplied from the A/D converter 93 has exceeded the contact pressure threshold value that is another preset threshold value (S120).

In step 120, when the pressure value represented by the contact pressure data is determined not to have exceeded the contact pressure threshold value, the CPU 94 reads the first octave pitch data stored in the field of "first octave" belonging to the record specified in step S110 (S130).

Subsequently, the CPU 94 supplies the sound source 97 with the sound source control signal that instructs generation of sound at a pitch represented by the one octave pitch data read in step 130 (S140). Thereby, sound at a pitch corresponding to standard embouchure is generated by the sound system 98.

When in step 120 the pressure value represented by the contact pressure data is determined to have exceeded the contact pressure threshold value, the CPU 94 reads the second octave pitch data stored in the field of "second octave" belonging to the record specified in step 110 (S150).

Next, the CPU 94 supplies the sound source 97 with a sound source control signal which instructs generation of sound at a pitch represented by the second octave pitch data read in step 150 (S160). Thus, the pitch of the sound that has been generated by the sound system 98 thus far is switched to a pitch corresponding to octave-raised embouchure.

The CPU 94 having supplied the sound source control signal in step 140 or 160 determines whether or not the pressure value represented by the breath pressure data that have been subsequently supplied from the A/D converter 93 has become smaller than the breath pressure threshold value (S170).

When the pressure value represented by the breath pressure data is determined to have become smaller than the breath pressure threshold value, the CPU 94 supplies the sound source 97 with the sound source control signal indicating a mute (S180). Generation of sound is stopped by the sound system 98, and processing subsequent to step 100 is iterated when the pressure value represented by the breath pressure data has again exceeded the breath pressure threshold value.

The electronic flute 1 of the present embodiment having been described thus far has the embouchure detection section 70 for measuring the pressure at which the lower lip of the performer is brought into contact with the lip plate 50. When the pressure value detected by the embouchure detection section 70 has exceeded the threshold value, the pitch of the sound output from the sound source 97 is changed higher by one octave. Thus, as a result of the contact pressure on the lip plate 50 being synchronized with the change in the octave of the sound output from the sound source 97, performance operability closer to that of the natural wind instrument can be implemented.

Second Embodiment

A second embodiment of the present invention will now be described.

In the first embodiment, each of the records forming the fingering table 96*a* includes three fields; namely, the field of "fingering," the field of "first octave," and the field of "second octave." A record to which a reference is to be made is specified in the table 96*a* while the fingering represented by the depressed key data is taken as a search key. Subsequently, a determination is made as to whether pitch data are read from the field of "first octave" or the field of "second octave" according to a result of comparison between the pressure represented by the contact pressure data and the contact pressure threshold value. In contrast, in the present embodiment, pitch data to be read are uniquely specified without making such a two-step determination, by making reference to the fingering table 96*a* while a combination of the result of comparison between the pressure value represented by the contact pressure data and the contact pressure threshold value with fingering represented by the depressed key data is taken as a search key.

The hardware configuration of the electronic flute 1 of the present embodiment is the same as that of the first embodiment, except for the data structure of the fingering table 96*a*. Each of the records constituting the fingering table 96*a* of the present embodiment has two fields; namely, the field of "fingering" and the field of "pitch." Pitch data indicating a pitch are stored in the field of pitch. Meanwhile, data showing a combination of fingering with a result of comparison between the contact pressure of the lip and the contact pressure threshold value (whether the contact pressure exceeds or is smaller than the threshold value) are stored in the field of "fingering." Therefore, even in the case of single fingering, the data representing the combination of the contact pressure threshold value with the value showing that the pressure value represented by the contact pressure data has exceeded the contact pressure threshold value are stored in one record, and the data showing the combination of the contact pressure threshold value with the value showing that the pressure value is not greater than the contact pressure threshold value are stored in another record.

Figure 8:
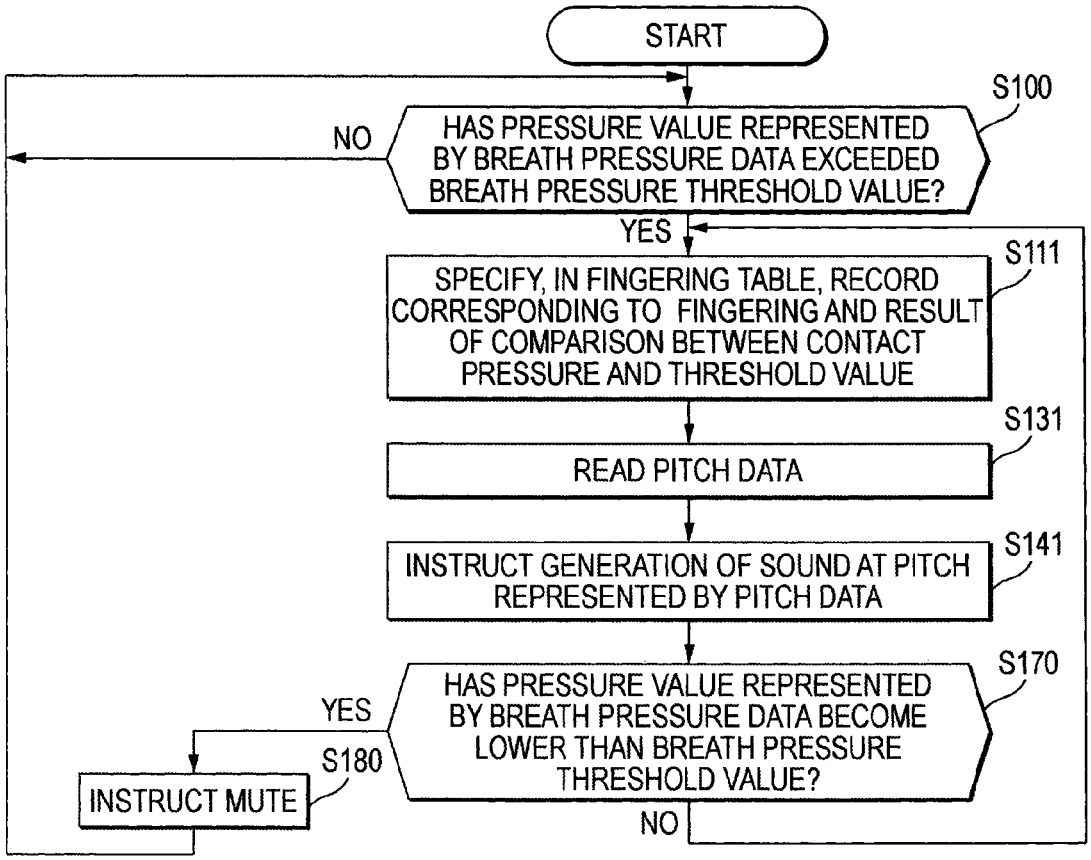
FIG. 8 is a flowchart showing operation of an electronic flute according to a second embodiment.

FIG. 8 is a flowchart showing operation of the electronic flute of the present embodiment. In the drawing, processing pertaining to steps 110 to 160 in FIG. 7 is replaced with processing pertaining to steps 111 to 141.

In step 111, the CPU 94 specifies, in the fingering table 96*a*, fingering represented by the depressed key data supplied from the A/D converter 93 and the record corresponding to a result of comparison of the pressure value represented by the contact pressure data with the contact pressure threshold value.

In subsequent step 131, the pitch data stored in the field of "pitch" pertaining to the record specified in step 111 are read. In step 141, the sound source 97 is supplied with a sound source control signal for instructing generation of sound at the pitch represented by the pitch data.

Even in the above-described embodiment, performance operability similar to that of the natural wind instrument can be embodied, and the pitch of sound output from the sound source 97 can be specified by a simpler algorithm.

Other Embodiments

The above embodiments can be altered in various manners.

The above embodiments are for realizing performance operability of a flute, which is a woodwind musical instrument, by an electronic musical instrument. However, the present invention may also be applied to another musical instrument which alters an octave by embouchure while fingering is fixed.

Figure 9A:
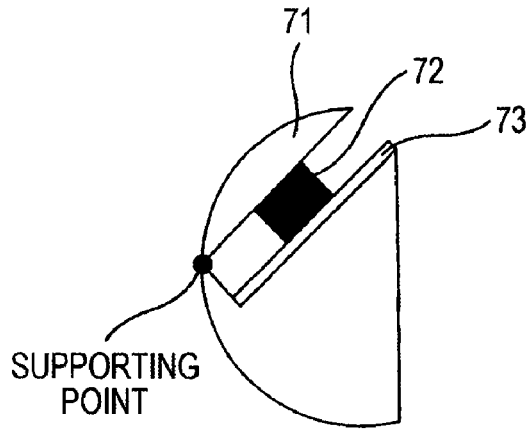
FIGS. 9A to 9C are views showing modified embodiments of the embouchure detection section.
Figure 9B:
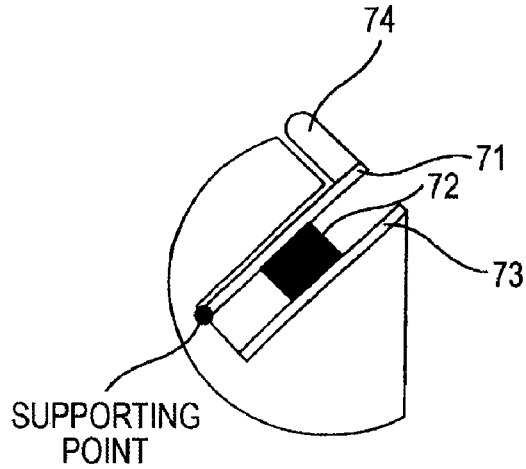
Figure 9C:
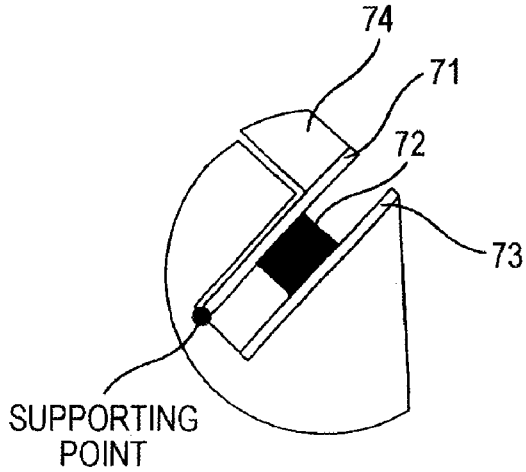

In the present embodiment, the essentially-linear protruding section 74 is provided on the front edge of the upper surface of the swinging portion 71 serving as a contact member of the lip plate 50 to be brought into contact with the lower lip of the performer. However, the swinging portion 71 may also be configured in another shape. For example, an outer shape of the swinging portion 71 to be brought into contact with the lower lip of the performer is shaped into a curved surface so as to continue to an outer shape of other portion of the lip plate 50 as shown in FIG. 9A. Moreover, the rear end of the swinging portion 71 is joined, in a vertically-swayable manner, to the upper ends of the lateral faces of the L-shaped indentation of the lip plate 50. However, the swinging portion 71 and the lip plate 50 may also be joined together in another positional relationship. For example, the swinging portion 71 may be pivotally jointed to an upper ends of the lateral faces of a U-shaped indentation of the lip plate 50 as shown in FIGS. 9B and 9C. Especially, the swinging portion 71 may be arranged in the U-shaped indentation of the lip plate 50. Further, the protruding section 74 provided on the swinging portion 71 may be shaped into a round portion as shown in FIG. 9B or a curves shape so as to continue to an outer shape of other portion of the lip plate 50 as shown in FIG. 9C. In short, no limitations are imposed on the positional relationship between the swinging portion 71 and the membrane switch 73 or the technique of joining them together, so long as the upper electrode sheet 73*a* of the membrane switch is joined to one end of the swinging portion 71 at a position where the upper electrode sheet can be depressed toward the lower electrode sheet 73*b*.

In the present embodiment, the electronic flute 1 incorporates the sound source 97 and the sound system 98. However, the electronic flute 1 is provided with an interface used for establishing connection with the external sound source 97. The external sound source 97 may also be controlled by outputting a sound source control signal via the interface. Upon receipt of a supply of a sound source control signal from the CPU 94, the sound source 97 of the present embodiment amplifies to a preset sound level the sound signal responsive to the sound source control signal, and supplies the sound system 98 with the amplified sound signal. Hence, the sound level of generated sound is constant regardless of strength of the breath of the performer. In contrast, there may also be adopted a configuration of synchronizing the pressure of the breath blown in from the breath inlet hole 51 with the sound level as well as with output or non-output of sound. In this modification, the CPU 94 having supplied the sound source 97 with the sound source control signal used for indicating an output of sound supplies the sound source 97 with a sound source control signal used for controlling a sound pressure level in accordance with the pressure value represented by the breath pressure data recently supplied to the CPU 94.

In the embodiments, when the pressure value detected by the embouchure detection section 70 exceeds the threshold value, the pitch of the sound output from the sound source 97 is changed higher than the pitch of the current sound by one octave. However, as alternative to the change of the octave, when the pressure value detected by the embouchure detection section 70 exceeds the threshold value, a pitch, a volume or a tone of the current sound may be slightly changed.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-367996 filed on Dec. 21, 2005, the contents of which are incorporated herein for reference.

What is claimed is:

1. An electronic transverse flute comprising:

a performance operation portion that is operated by fingers of a performer;

a lip plate including a breath inlet hole;

an embouchure detection section that includes a contact portion that is adapted to be brought into contact with a lower lip of the performer, wherein one end of the contact portion is pivotally connected to lip plate; and a contact pressure detection portion that detects a contact pressure at which the lower lip is brought into contact with the contact portion and generates a pressure value in accordance with the detected contact pressure; and a control portion that specifies sound of a pitch in accordance with an operation status of the performance operation portion and changes the pitch of the sound in accordance with the pressure value.

2. The electronic transverse flute according to claim 1, wherein the contact pressure detection portion comprises a membrane switch including an upper electrode sheet having an electrode on a front surface thereof, a lower electrode sheet having an electrode on a front surface thereof, and a pressure-sensitive conductor sandwiched between the front surfaces of the upper and lower electrode sheets;

wherein a back surface of the lower electrode sheet is bonded to the lip plate; and wherein the contact portion comprises a swinging portion that is pivotally jointed to the lip plate and moveable to depress the upper electrode sheet toward the lower electrode sheet in response to the contact pressure applied by the lower lip being brought into contact with the contact portion.

3. The electronic transverse flute according to claim 2, wherein a protruding section is provided on the swinging portion.

4. The electronic transverse flute according to claim 2, wherein the control portion determines whether or not the pressure value exceeds a predetermined threshold value; and wherein the control portion changes the pitch of the current sound to a pitch which is one octave higher than the pitch of the current sound when it is determined that the pressure value exceeds the threshold value.

5. The electronic transverse flute according to claim 1, wherein a protruding section is provided on the contact portion.

6. The electronic transverse flute according to claim 5, wherein the control portion determines whether or not the pressure value exceeds a predetermined threshold value; and wherein the control portion changes the pitch of the current sound to a pitch which is one octave higher than the pitch of the current sound when it is determined that the pressure value exceeds the threshold value.

7. The electronic transverse flute according to claim 1, wherein the control portion determines whether or not the pressure value exceeds a predetermined threshold value; and wherein the control portion changes the pitch of the current sound to a pitch which is one octave higher than the pitch of the current sound when it is determined that the pressure value exceeds the threshold value.

8. The electronic transverse flute according to claim 1, wherein the control portion determines whether or not the pressure value exceeds a predetermined threshold value; and wherein the control portion slightly changes a pitch, a volume or a tone of the current sound when it is determined that the pressure value exceeds the threshold value.

9. The electronic transverse flute according to claim 1, wherein the contact portion comprises a swinging portion that is pivotally jointed to the lip plate and moveable to depress the upper electrode sheet toward the lower electrode sheet in response to the contact pressure applied by the lower lip being brought into contact with the contact portion.

10. A computer-readable recording medium encoded with instructions for causing an electronic transverse flute to execute a pitch changing method, the flute including a performance operation portion that is operated by fingers of a performer, a lip plate including a breath inlet hole; an embouchure detection section that includes a contact portion that is adapted to be brought into contact with a lower lip of the performer, wherein one end of the contact portion is pivotally connected to the lip plate; and a contact pressure detection portion that detects a contact pressure at which the lower lip is brought into contact with the contact portion and generates a pressure value in accordance with the detected contact pressure, the method comprising:

specifying sound of a pitch in accordance with an operation status of the performance operation portion; and changing the pitch of the sound in accordance with the pressure value.

11. An electronic flute comprising:

an upper pipe section and a main pipe section; and a lip plate, including a breath inlet hole and an embouchure detection, provided on the upper pipe section;

wherein an indentation is formed in a base section of an area forward of the breath inlet hole of the lip plate;

wherein the embouchure detection section includes a swinging portion and a membrane switch;

wherein the membrane switch includes an upper electrode sheet having an electrode on a front surface thereof and a lower electrode sheet having an electrode on a front surface thereof arranged in such a way that a membrane space and pressure-sensitive conductive material are sandwiched between the front surfaces of the upper and the lower electrode sheets;

wherein the swinging portion comprises a member including a tapered shape which becomes thinner from an upper face to a lower face, and a rear end of the upper face is joined to upper ends of lateral faces of the indentation so as to become swayable, and a protruding section is provided at the upper face of the swinging portion; and wherein the swinging portion transmits contact force exerted by a lower lip of a performer to the membrane switch.

12. The electronic flute as claimed in claim 11, wherein a formed rubber is affixed to the lower face of the swinging portion.

* * * * *